US007819708B2

(12) United States Patent
Ngo

(10) Patent No.: US 7,819,708 B2
(45) Date of Patent: Oct. 26, 2010

(54) RECEPTACLE CONTACT FOR IMPROVED MATING CHARACTERISTICS

(75) Inventor: Hung Viet Ngo, Harrisburg, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/284,212

(22) Filed: Nov. 21, 2005

(65) Prior Publication Data

US 2007/0117472 A1 May 24, 2007

(51) Int. Cl.
*H01R 11/22* (2006.01)
*H01R 13/11* (2006.01)

(52) U.S. Cl. ..... 439/856

(58) Field of Classification Search ..... 439/862, 439/682, 856–857
See application file for complete search history.

(56) References Cited

U.S. PATENT DOCUMENTS

| | | | | |
|---|---|---|---|---|
| 3,115,379 | A | 12/1963 | McKee | 339/47 |
| 3,286,220 | A | 11/1966 | Marley et al. | 439/680 |
| 3,538,486 | A | 11/1970 | Shlesinger, Jr. | 439/268 |
| 3,669,054 | A | 6/1972 | Desso et al. | 113/119 |
| 3,704,441 | A | 11/1972 | Douglass | 339/220 |
| 3,725,853 | A | 4/1973 | McKeown et al. | 339/252 |
| 3,731,252 | A | 5/1973 | McKeown et al. | 339/17 |
| 3,748,633 | A * | 7/1973 | Lundergan | 439/682 |
| 4,076,362 | A | 2/1978 | Ichimura | 339/75 |
| 4,140,361 | A | 2/1979 | Sochor | 339/258 |
| 4,159,861 | A | 7/1979 | Anhalt | 339/75 |
| 4,260,212 | A | 4/1981 | Ritchie et al. | 339/97 |
| 4,288,139 | A | 9/1981 | Cobaugh et al. | 339/74 |
| 4,383,724 | A | 5/1983 | Verhoevan | 439/510 |
| 4,402,563 | A | 9/1983 | Sinclair | 339/75 |
| 4,480,888 | A | 11/1984 | Hopkins et al. | 339/74 |
| 4,560,222 | A | 12/1985 | Dambach | 339/75 |
| 4,607,907 | A | 8/1986 | Bogursky | 339/258 |
| 4,684,193 | A | 8/1987 | Havel | 439/259 |
| 4,717,360 | A | 1/1988 | Czaja | 439/710 |
| 4,728,164 | A | 3/1988 | Lemmens et al. | 439/870 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |

(Continued)

FOREIGN PATENT DOCUMENTS

| | | |
|---|---|---|
| EP | 0 273 683 A2 | 7/1988 |

(Continued)

*Primary Examiner*—Felix O Figueroa
(74) *Attorney, Agent, or Firm*—Woodcock Washburn LLP

(57) ABSTRACT

A first contact beam of a receptacle contact may define an indentation and a second contact beam may define a protrusion such that the protrusion may at least partially extend into the indentation. The protrusion may extend across the center of the receptacle contacts, and therefore the normal force created by each contact beam may be exerted against the normal force created by the other contact beam. Thus, rotation of a blade contact inserted into the receptacle contact may be reduced or eliminated. The contact beams of the receptacle contact may each include a formed area placed at different locations on the receptacle contact. A blade contact may overcome the normal force and mechanical resistance of a formed area of one of the contact beams before being confronted by the normal force and mechanical resistance of the other beam's formed area.

15 Claims, 7 Drawing Sheets

U.S. PATENT DOCUMENTS

| | | | | | |
|---|---|---|---|---|---|
| 4,878,861 | A | | 11/1989 | Kendall et al. | 439/751 |
| 4,907,990 | A | | 3/1990 | Bertho et al. | 439/851 |
| 4,936,797 | A | | 6/1990 | Wehrle et al. | 439/751 |
| 4,964,814 | A | | 10/1990 | Tengler et al. | 439/607 |
| 4,973,271 | A | | 11/1990 | Ishizuka et al. | 439/839 |
| 5,004,426 | A | * | 4/1991 | Barnett | 439/82 |
| 5,066,236 | A | | 11/1991 | Broeksteeg | 439/79 |
| 5,077,893 | A | | 1/1992 | Mosquera et al. | 29/882 |
| 5,174,770 | A | | 12/1992 | Sasaki et al. | 439/108 |
| 5,238,414 | A | | 8/1993 | Yaegashi et al. | 439/108 |
| 5,254,012 | A | | 10/1993 | Wang | 439/263 |
| 5,274,918 | A | | 1/1994 | Reed | 29/882 |
| 5,302,135 | A | | 4/1994 | Lee | 439/263 |
| 5,403,215 | A | | 4/1995 | Buchter et al. | 439/869 |
| 5,431,578 | A | | 7/1995 | Wayne | 439/259 |
| 5,475,922 | A | | 12/1995 | Tamura et al. | 29/881 |
| 5,487,684 | A | | 1/1996 | Schalk et al. | 439/715 |
| 5,558,542 | A | | 9/1996 | O'Sullivan et al. | 439/682 |
| 5,564,954 | A | | 10/1996 | Wurster | 439/751 |
| 5,573,431 | A | | 11/1996 | Wurster | 439/751 |
| 5,588,859 | A | | 12/1996 | Maurice | 439/290 |
| 5,590,463 | A | | 1/1997 | Feldman et al. | 29/844 |
| 5,609,502 | A | | 3/1997 | Thumma | 439/747 |
| 5,645,436 | A | | 7/1997 | Shimizu et al. | 439/108 |
| 5,676,570 | A | | 10/1997 | Scherer | 439/787 |
| 5,697,818 | A | | 12/1997 | Fukuda | 439/751 |
| 5,730,609 | A | | 3/1998 | Harwath | 439/108 |
| 5,741,144 | A | | 4/1998 | Elco et al. | 439/101 |
| 5,741,161 | A | | 4/1998 | Cahaly et al. | 439/709 |
| 5,761,050 | A | | 6/1998 | Archer | 361/791 |
| 5,795,191 | A | | 8/1998 | Preputnick et al. | 439/608 |
| 5,817,973 | A | | 10/1998 | Elco et al. | 174/32 |
| 5,908,333 | A | | 6/1999 | Perino et al. | 439/631 |
| 5,961,355 | A | | 10/1999 | Morlion et al. | 439/686 |
| 5,971,817 | A | | 10/1999 | Longueville | 439/857 |
| 5,980,271 | A | | 11/1999 | MacDougall et al. | 439/78 |
| 5,980,321 | A | | 11/1999 | Cohen et al. | 439/608 |
| 5,993,259 | A | | 11/1999 | Stokoe et al. | 439/608 |
| 6,042,389 | A | | 3/2000 | Lemke et al. | 439/74 |
| 6,050,862 | A | | 4/2000 | Ishii | 439/843 |
| 6,068,520 | A | | 5/2000 | Winings et al. | 439/676 |
| 6,123,554 | A | | 9/2000 | Ortega et al. | 439/79 |
| 6,125,535 | A | | 10/2000 | Chiou et al. | 29/883 |
| 6,139,336 | A | | 10/2000 | Olson | 439/83 |
| 6,146,157 | A | | 11/2000 | Lenoir et al. | 439/101 |
| 6,146,203 | A | | 11/2000 | Elco et al. | 439/608 |
| 6,190,213 | B1 | | 2/2001 | Reichart et al. | 439/736 |
| 6,212,755 | B1 | | 4/2001 | Shimada et al. | 29/527.1 |
| 6,219,913 | B1 | | 4/2001 | Uchiyama | 29/883 |
| 6,220,896 | B1 | | 4/2001 | Bertoncini et al. | 439/608 |
| 6,269,539 | B1 | | 8/2001 | Takahashi et al. | 29/883 |
| 6,293,827 | B1 | | 9/2001 | Stokoe et al. | 439/608 |
| 6,319,075 | B1 | | 11/2001 | Clark et al. | 439/825 |
| 6,325,643 | B1 | | 12/2001 | Ohtsuki et al. | 439/82 |
| 6,328,602 | B1 | | 12/2001 | Yamasaki et al. | 439/608 |
| 6,347,952 | B1 | | 2/2002 | Hasegawa et al. | 439/608 |
| 6,350,134 | B1 | | 2/2002 | Fogg et al. | 439/79 |
| 6,363,607 | B1 | | 4/2002 | Chen et al. | 29/883 |
| 6,371,773 | B1 | | 4/2002 | Crofoot et al. | 439/79 |
| 6,379,188 | B1 | | 4/2002 | Cohen et al. | 439/608 |
| 6,386,914 | B1 | | 5/2002 | Collins et al. | 439/579 |
| 6,409,543 | B1 | | 6/2002 | Astbury, Jr. et al. | 439/608 |
| 6,431,914 | B1 | | 8/2002 | Billman | 439/608 |
| 6,435,914 | B1 | | 8/2002 | Billman | 439/608 |
| 6,454,575 | B1 | | 9/2002 | Jones et al. | 439/79 |
| 6,454,615 | B1 | | 9/2002 | Yu | 439/752.5 |
| 6,461,202 | B2 | | 10/2002 | Kline | 439/701 |
| 6,471,548 | B2 | | 10/2002 | Bertoncini et al. | 439/608 |
| 6,506,081 | B2 | | 1/2003 | Blanchfield et al. | 439/682 |
| 6,537,111 | B2 | | 3/2003 | Brammer et al. | 439/857 |
| 6,554,647 | B1 | | 4/2003 | Cohen et al. | 439/607 |
| 6,572,410 | B1 | | 6/2003 | Volstorf et al. | 439/608 |
| 6,652,318 | B1 | | 11/2003 | Winings et al. | 439/608 |
| 6,692,272 | B2 | | 2/2004 | Lemke et al. | 439/108 |
| 7,229,324 | B2 | * | 6/2007 | van der Steen | 439/682 |
| 2001/0010979 | A1 | | 8/2001 | Ortega et al. | 439/79 |
| 2003/0143894 | A1 | | 7/2003 | Kline et al. | 439/608 |
| 2003/0220021 | A1 | | 11/2003 | Whiteman, Jr. et al. | 439/608 |
| 2005/0221682 | A1 | | 10/2005 | Stoner | |
| 2007/0004291 | A1 | | 1/2007 | Bogiel et al. | |

FOREIGN PATENT DOCUMENTS

| | | |
|---|---|---|
| JP | 06-236788 | 8/1994 |
| JP | 07-114958 | 5/1995 |
| JP | 10/003969 | 1/1998 |
| JP | 2000-003743 | 1/2000 |
| JP | 2000-003744 | 1/2000 |
| JP | 2000-003745 | 1/2000 |
| JP | 2000-003746 | 1/2000 |
| WO | WO 01/29931 A1 | 4/2001 |
| WO | WO 01/39332 A1 | 5/2001 |

* cited by examiner

RECEPTACLE CONTACT FOR IMPROVED MATING CHARACTERISTICS

CROSS-REFERENCE TO RELATED APPLICATIONS

The subject matter disclosed in this patent application is related to the subject matter disclosed and claimed in U.S. patent application Ser. No. 11/087,047, filed Mar. 22, 2005, which is a continuation of U.S. patent application Ser. No. 10/294,966, filed on Nov. 14, 2002, which is a continuation-in-part of U.S. Pat. Nos. 6,652,318 and 6,692,272. The subject matter disclosed in this patent application is also related to the subject matter disclosed and claim in U.S. patent application Ser. No. 10/232,883 filed Aug. 30, 2002. The contents of each of the above-referenced U.S. patents and patent applications are herein incorporated by reference in their entireties.

FIELD OF THE INVENTION

The invention relates to electrical connectors. More particularly, the invention relates to receptacle contacts in electrical connectors.

BACKGROUND OF THE INVENTION

Electrical connectors may include receptacle contacts such as the receptacle contact 110 shown in FIGS. 1A-1E. FIG. 1A is a side view of a lead frame assembly 100 that includes receptacle contacts 110. FIGS. 1B and 1D are end views of the lead frame assembly 100. FIGS. 1C and 1E are top views of a contact 110. FIGS. 1D and 1E additionally depict a blade contact 150 being inserted into the receptacle contact 110.

Referring to FIG. 1A, the receptacle contacts 110 may be inserted into or otherwise formed as part of a contact block 120 to form a lead frame assembly 100. The lead frame assembly 100 may be an insert-molded lead frame assembly and may include both signal receptacle contacts 110S and ground receptacle contacts 110G. The receptacle contacts 110 may include terminal ends 130 for connecting with an electrical device such as, for example, a printed circuit board. The receptacle contacts 110 additionally may include dual contact beams 110A, 110B, each for connecting with opposing sides of a complementary plug contact of a second electrical connector. Such a plug contact may be, for example, a blade contact 150 (FIGS. 1D and 1E).

The receptacle contacts 110 may be stamped or otherwise formed from a single sheet of conductive material. For example, as shown in FIG. 1A, one or more stamped contacts may be formed from a single sheet of conductive material such that, for example, the contact beam 110A is separated from the contact beam 110B by a space S. As shown in FIG. 1B, the contact beam 110A may be bent at a location f away from the beam 10B. The beam 110A may additionally be bent or formed to include a formed area 111A at a location labeled CL. The formed area 111A may protrude toward the beam 110B. In a similar manner, the beam 110B may be bent at the location f away from the beam 110A and may include a formed area 111B at the location labeled CL protruding toward the beam 110A. Thus the dual contact beams 110A, 110B may be generally aligned so that the blade contact 150 may electrically connect with both beams 110A, 110B when inserted into the receptacle contact 110.

Problems, however, may be created by such receptacle contacts 110. As shown for example in FIG. 1E, when the blade contact 150 is inserted into the receptacle contact 110, each of the dual contact beams 110A, 110B may place offset opposing normal forces NF on the blade contact 150, forcing the blade contact 150 to rotate in a clockwise direction. Thus, signal integrity may be affected, as the blade contact 150 may not maximally contact each beam 110A, 110B. Additionally, because the formed areas 111A, 111B are formed at the same location CL, an insertion force IF may be exerted to overcome the normal force NF exerted by each contact beam 110A, 110B. Additionally, the insertion force IF may be exerted to overcome mechanical resistance (e.g., friction) of each contact beam 110A, 110B. If the insertion force IF is large, placing such a force on an electrical connector or on individual contacts 110, 150 may cause damage to one or both connectors in the form of, for example, bent or broken contacts 110, 150. Moreover, the space S between each beam 110A, 110B may create a waste area 150A (FIG. 1E) where the blade contact 150, even without rotation, does not contact the beams 110A, 110B. Such a waste area 150A may affect signal integrity.

SUMMARY OF THE INVENTION

A receptacle contact may include two contact beams between which a second contact such as a blade contact may be inserted. A first contact beam may define an indentation and the second contact beam may define a protrusion such that the protrusion may at least partially extend into the indentation. Likewise, the second contact beam may define an indentation and the first contact beam may define a protrusion such that the protrusion at least partially extends into the indentation. Thus, a second contact inserted between the beams of the receptacle contact may abut and electrically connect with the protrusions. Because the protrusions may extend across the center of the receptacle contacts, the normal force created by each contact beam may be exerted against the normal force created by the other contact beam. Thus, rotation of the blade contact inserted into the receptacle contact may be reduced or eliminated. Additionally, the mating surface area between the contact beams and the blade contact may be maximized. The protrusions can partially overlap, such as by an equal amount or a length of one of the protrusions, to prevent rotation of the blade contact.

The contact beams of the receptacle contact may each include a formed area that is "bent" or shaped to extend toward the other contact beam. The formed areas, however, may be placed at different locations on the receptacle contact so that, when a blade contact is inserted between the two contact beams, the blade contact abuts one of the beam's formed area. As the blade contact is inserted further into the receptacle contact, the blade contact will then abut the other beam's formed area. In this way, the blade contact may overcome the normal force and mechanical resistance of a formed area of one of the contact beams before being confronted by the normal force and mechanical resistance of the other beam's formed area. The insertion force exerted to insert the blade contact fully into the receptacle contact thus may be less than might be required if confronted with the normal forces and mechanical resistance of both formed areas at the same time.

DETAILED DESCRIPTION OF ILLUSTRATIVE EMBODIMENTS

Figure 2:
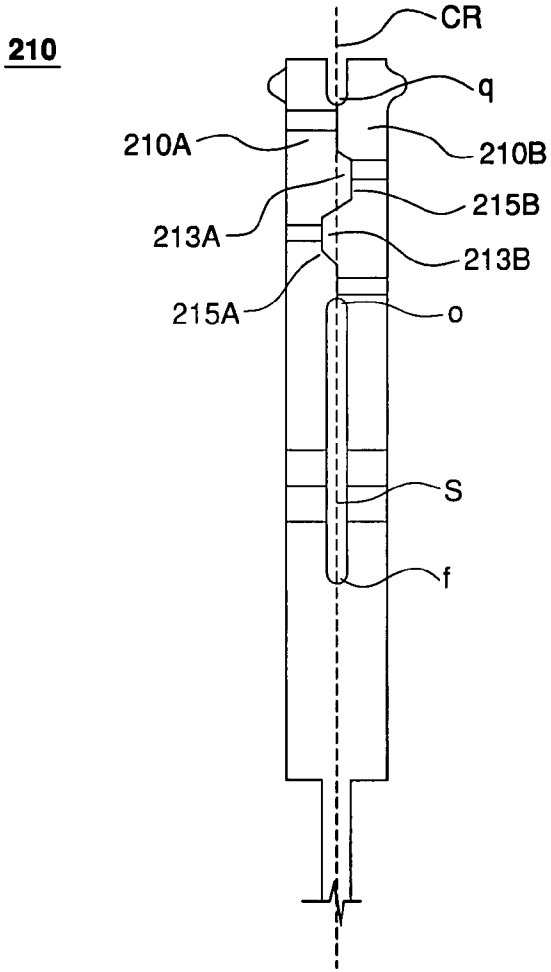
FIG. 2 is a side view of an alternative receptacle contact.

FIG. 2 is a side view of a receptacle contact 210. The receptacle contact 210 may be used in an electrical connector, for example, and may receive a plug contact such as a blade contact. Additionally, the receptacle contact 210 may include a terminal portion for connection with an electrical device such as, for example, a printed circuit board.

The receptacle contact 210 may include two beams 210A, 210B that separate from each other at a location f. A space S may be formed between the beams 210A, 210B and may extend partially within the contact 210 between the location f and a location o, for example. Between the location o and a location q, the dual beams 210A, 210B may be shaped into complementary forms such that a protrusion 213A, 213B on one beam 210A, 210B extends toward an indentation 215A, 215B defined by the other beam 210A, 210B. For example, the beam 210B may include a protrusion 213B that extends toward the beam 210A. The protrusion 213B may extend from the beam 210B beyond a center reference line CR of the contact 210. At the location of the protrusion 213B, the contact beam 210A may define a corresponding indentation 215A. Likewise, the contact beam 210A may include a protrusion 213A. The protrusion 213 may extend from the beam 210A toward the beam 210B past the center reference line CR. The beam 210B may define an indentation 215B that corresponds to the protrusion 213A. Such a receptacle contact 210 may include any number of corresponding protrusions 213 and indentations 215.

The dual beam receptacle contact 210 may be stamped or otherwise produced from a single sheet of conductive material in a shape such as described herein and depicted in FIG. 2. Further, as explained in more detail herein, receptacle contacts 210 may enable "overlapping" of portions of the contact beams 210A, 210B such that each places an opposing normal force on a blade contact, reducing or eliminating rotation of the blade contact when inserted into the receptacle contact 210. The overlapping portions of the contact beams 210A, 210B may also result in increased mating surface area with a blade contact and thus may affect signal integrity.

Figure 3C:
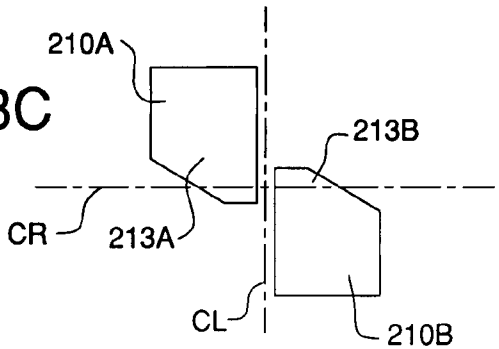
FIG. 3C is a top view of the alternative receptacle contact.
Figure 3B:
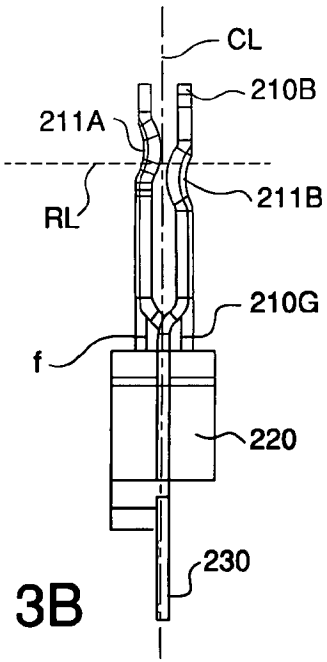
FIGS. 3A and 3B are side and end views, respectively, of a lead frame assembly that includes the alternative receptacle contact of FIG. 2.
Figure 3A:
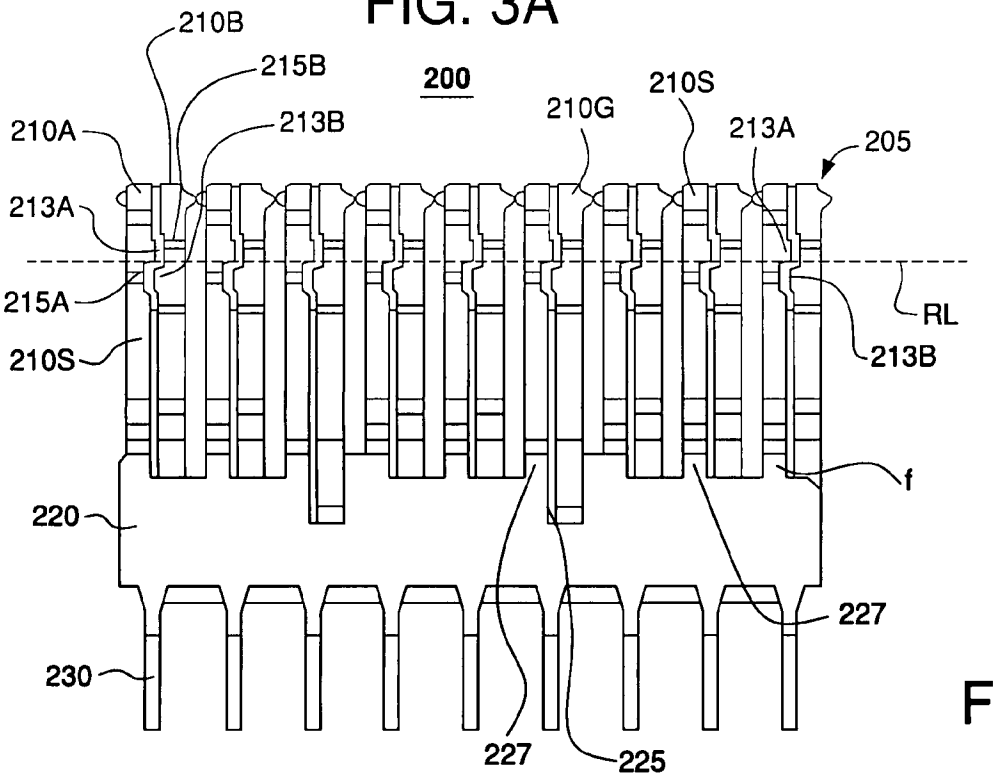

FIG. 3A is a side view of a lead frame assembly 200 that includes the receptacle contacts 210. FIG. 3B is an end view of the lead frame assembly 200. FIG. 3C is a top view of the receptacle contact 210. The lead frame assembly 200 may include a lead frame 205 within a contact block 220. The lead frame 205 may include a row of receptacle contacts 210. The lead frame 205 may be made, formed, or stamped at one time. The contact block 220 may be insert-molded around the lead frame 205 and may secure the lead frame 205 within the contact block 220. This is further described in U.S. patent application Ser. No. 10/232,883. Alternatively, the contacts 210 may be individually made, formed or stamped and/or the contacts 210 may be inserted into the contact block 220 or formed as part of an insert-molded contact block 220.

As described in FIG. 2, the receptacle contacts 210 may include the dual contact beams 210A, 210B for receiving a blade contact. Additionally, the receptacle contacts 210 may include any type of terminal end 230 for connection with an electrical device such as, for example, a printed circuit board. The receptacle contacts 210 within the lead frame assembly 200 may include signal contacts 210S and ground contacts 210G. The ground contacts 210G may be located within the contact block 220 such that they correspond to wells 225 within the contact block 225.

The wells 225 are further described in U.S. patent application Ser. No. 10/232,883, and provide a capability for the lead frame assembly 200 to receive ground blade contacts that are longer than signal blade contacts. A plug connector may include ground blade contacts that are longer than signal blade contacts so that, when connecting with a receptacle connector, the ground blade contacts electrically connect with ground receptacle contacts before the signal blade contacts connect with signal receptacle contacts. Thus, the wells 225 allow for receiving such longer ground contacts without the contacts "bottoming out" on the contact block 220 before the signal blade contacts are fully connected and the plug connector is fully seated.

After the receptacle contacts 210 are made, formed, or stamped, the individual beam 210A, 210B may be bent so that the contact 210 can receive a blade contact of a plug connector, for example. As shown in FIG. 3B, the beam 210A, 210B may be bent at the location f so that they move away from each other and away from a centerline CL.

The contact beams 210A, 210B each may additionally be bent or formed to include a respective formed area 211A, 211B. The formed area 211A may protrude toward the beam 210B, and the formed area 211B may protrude toward the beam 210A. Additionally, a horizontal reference line RL aids in showing that the location of the formed area 211A may correspond to the location of the protrusion 213A shown in FIG. 3A. The location of the formed area 211B may correspond to the location of the protrusion 213B shown in FIG. 3A. Thus, the protrusions 213A, 213B may be formed such that each electrically connects to a respective side of a blade contact inserted into the receptacle contact 210.

Figure 1C:
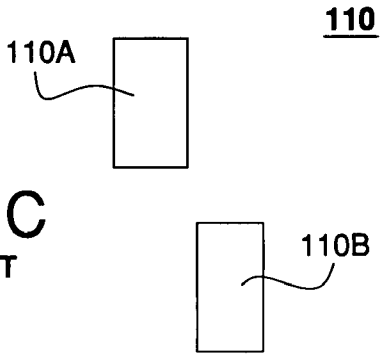
FIG. 1C PRIOR ART
FIG. 1C is a top view of a receptacle contact.
Figure 1B:
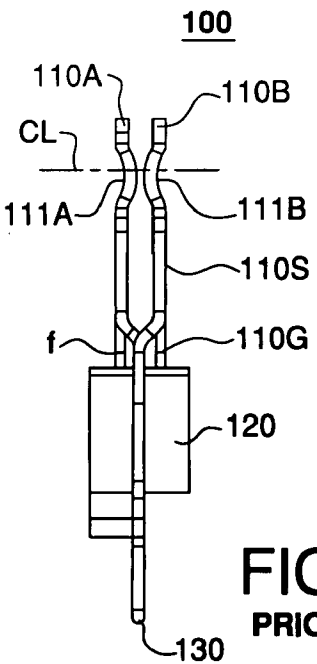
FIG. 1B PRIOR ART
FIG. 1B is an end view of the lead frame assembly of FIG. 1A.

The formed area 211A may be in a location so that it is offset from the formed area 211B. That is, the formed area 211A may be further from the location f or the contact block 220 than the formed area 211B. Thus, a blade contact that is inserted into the receptacle contact 210 may abut the contact beam 210A before abutting the contact beam 210B. As described in more detail herein, the insertion force necessary to insert a blade contact into the receptacle contact 210 may be less than the insertion force necessary to insert a blade contact into the receptacle contact 110 (FIG. 1B). Because the blade contact abuts the contact beam 210A during initial insertion, the insertion force required to overcome the normal force exerted by the beam 210A as well as its mechanical resistance, such as friction, may be less than the insertion force required to overcome the normal force and mechanical resistance of both blades 110A, 110B of the dual beam contact 110. Additionally, as the blade contact is inserted further and begins to abut the formed area 211B of the beam 210B, an insertion force may be necessary to overcome the normal force and mechanical friction of the beam 210B. Because the blade contact largely overcame these forces with respect to the beam 210A, however, less insertion force may be required to fully insert the contact blade in the receptacle contact 210 than if the contact blade was confronted with the normal force and mechanical resistance of both beams 210A, 210B at the same time.

FIG. 3C depicts a top view of the receptacle contact 210, shown as it is oriented in FIG. 3B. In FIG. 3C, the contact block and the portion of the receptacle contact in the vicinity of the location f are not shown for the sake of clarity. The receptacle contact 210 is depicted in FIG. 3C in its "unloaded" position, that is, without a blade contact inserted. The contact beam 210A is shown on the left-hand side of the centerline CL. The protrusion 213A is shown extending past the center reference line CR, which is also shown in FIG. 2, toward the bottom of the page.

The contact beam 210B is shown on the right-hand side of the centerline CL. The protrusion 213B is shown extending past the center reference line CR toward the top of the page. Thus, the receptacle contact 210 is formed such that the protrusions 213A, 213B of each contact beam 210A, 210B "overlap," that is, extend past the center of the receptacle contact 210 as denoted by the center reference line CR. As described herein, the protrusions 213A, 213B may aid in reducing or preventing rotation of a blade contact when inserted or received in the receptacle contact 210. The protrusions 213A, 213B additionally may increase the mating surface area of the receptacle contact/blade contact connection.

Figure 4B:
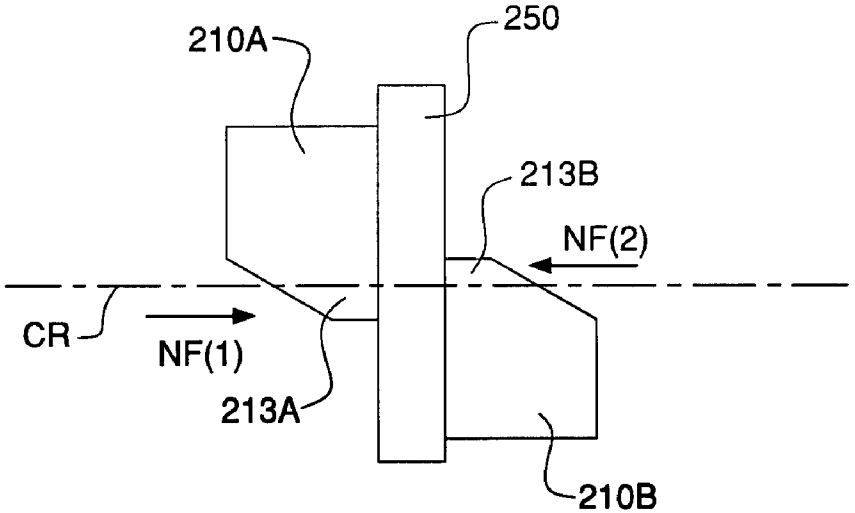
FIGS. 4A and 4B are, respectively, an end view and a top view of the alternative receptacle contact with a blade contact partially inserted.
Figure 4A:
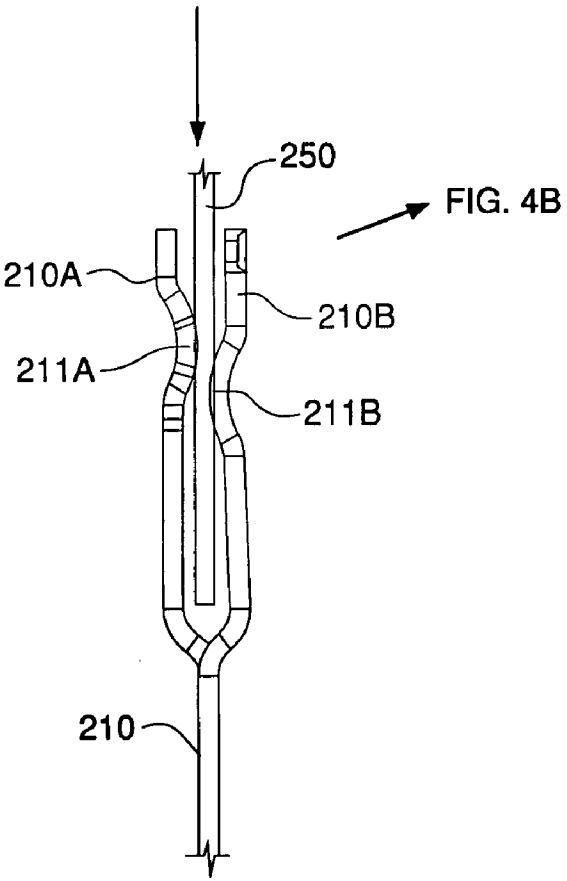

FIG. 4A depicts a receptacle contact 210 with a blade contact 250 partially inserted between the contact beams 210A, 210B. FIG. 4B is a top view of the receptacle contact 210 and the blade contact 250 when the showing the blade contact 250 abutting both the formed area 211A of the contact beam 210A and the formed area 211B of the contact beam 210B. In FIG. 4B, the contact block 220 and the portion of the receptacle contact in the vicinity of the location f shown in FIG. 3A are not shown for the sake of clarity.

FIG. 4B shows that the "overlapping" contact beams 210A, 210B may reduce or minimize rotating of the blade contact 250 when it is inserted in the receptacle contact 210. Each contact beam 210A, 210B may, in part, exert opposing normal forces on the blade contact 250. For example, as the blade contact 250 is inserted into the receptacle contact 210, the contact beam 210A may exert a first normal force NF(1) toward the blade contact 250. As the blade contact 250 is inserted further, the contact beam 210B may exert a normal force NF(2) opposite the first normal force NF(1) toward the blade contact 250.

The protrusion 213A may extend across a center of the receptacle contact 210, denoted by the center reference line CR, and thus may enable the normal force NF(1) exerted by the contact beam 210A to at least partially counteract the normal force NF(2) of the contact beam 210B. This counteraction may aid in preventing the normal force NF(2) exerted by the contact beam 210B to rotate the blade contact 250 clockwise. The protrusion 213B may extend across a center of the receptacle contact 210, again denoted by the center reference line CR, and thus may enable the normal force NF(2) exerted by the contact beam 210B to at least partially counteract the normal force NF(1) of the contact beam 210A. This counteraction may aid in preventing the normal force NF(1) exerted by the contact beam 210A to rotate the blade contact 250 clockwise.

Figure 5B:
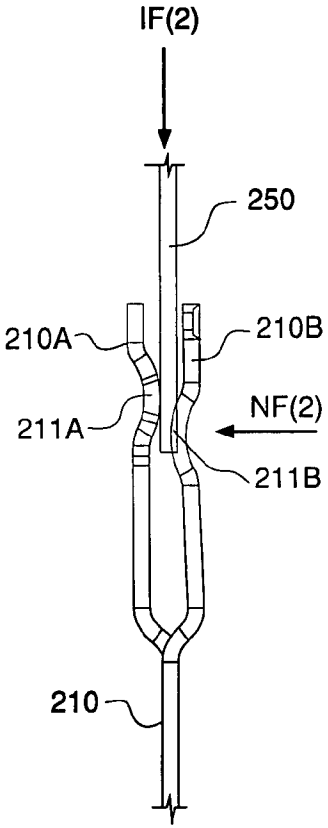
FIGS. 5A and 5B depict a receptacle contact receiving a blade contact.
Figure 5A:
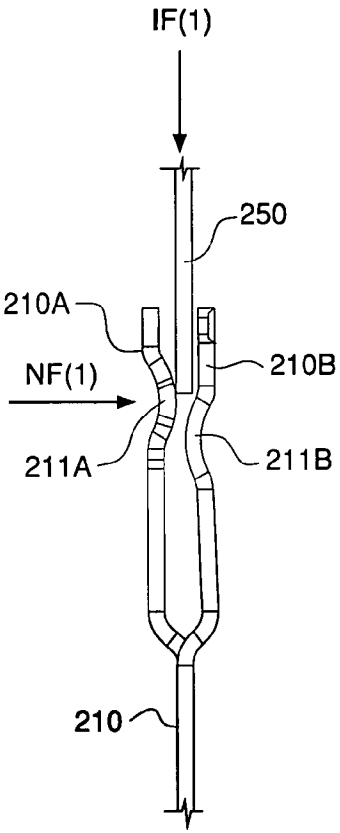

Thus, the protrusions 213A, 213B may help reduce or prevent rotation of a blade contact 250 inserted into the receptacle contact 210. Additionally because, as shown and described in, for example, FIGS. 2 and 3A, the offsetting of the protrusions along the respective contact beams 210A, 210B may enable the receptacle contact 210 to be stamped or otherwise formed from a single sheet of conductive material. As shown in FIGS. 5A and 5B, the offsetting of the formed areas 211A, 211B in a manner similar to the offsetting of the protrusions 213A, 213B may allow for insertion of a blade contact 250 with a lower insertion force than would be exerted if the formed areas 211A, 211B were not offset.

FIGS. 5A and 5B show a receptacle contact 210 receiving a blade contact 250. In FIG. 5A, the blade contact 250 is partially inserted and is abutting the contact beam 210A in the area of its formed area 211A. In FIG. 5B, the blade contact 250 is partially inserted and is abutting the contact beams 210A, 210B at the respective formed areas 211A, 211B.

Referring first to FIG. 5A, as the blade contact 250 is inserted into a receptacle contact 210, an insertion force IF(1) may be exerted on the blade contact 250 in a direction of insertion to overcome a normal force NF(1) exerted by the contact beam 210A in the area of its formed area 211A. The insertion force IF(1) may also be exerted to overcome any mechanical resistance, such as friction, presented by the contact beam 210A as the blade contact 250 first abuts and then slides along the contact beam 210A. Because the blade contact 250 abuts the formed area 211A of the contact beam 210A before abutting the formed area 211B of the contact beam 210B, however, less of an insertion force IF(1) may be needed than if the blade contact 250 was confronted with overcoming a normal force NF(2) and mechanical resistance presented by the contact beam 210B in addition to the normal force NF(1) and resistance of the contact beam 210A.

As the blade contact 250 continues its insertion journey past the formed area 211A, it may then abut the formed area 211B, as shown in FIG. 5B. An insertion force IF(2) may be exerted in the direction of insertion to overcome the normal force NF(2) and any mechanical resistance of the formed area 211B of the contact beam 210B. Because at this point, the blade contact 250 may have largely overcome the normal force NF(1) and mechanical resistance of the contact beam 210A, the insertion force IF(2) exerted to overcome the normal force NF(2) and mechanical resistance of the contact beam 210A may be less than if the blade contact 250 was confronted with overcoming the combined normal forces NF(1), NF(2) and mechanical resistance of both contact beams 210A, 210B simultaneously.

Thus, by offsetting the formed areas 211A, 211B along the length of respective contact beams 210A, 210B, the insertion forces IF(1), IF(2) each may be less than if the formed area 211 A was located at a same point on the contact beam 210A as the formed area 211B on the contact beam 210B.

Figure 1A:
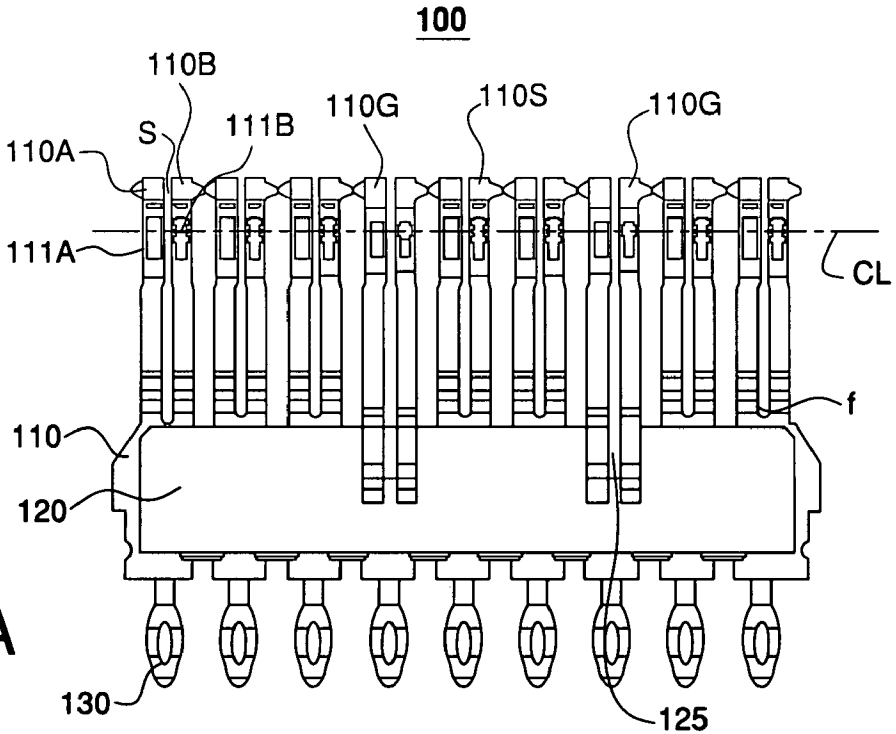
FIG. 1A PRIOR ART
FIG. 1A is a side view of an example lead frame assembly.
Figure 1E:
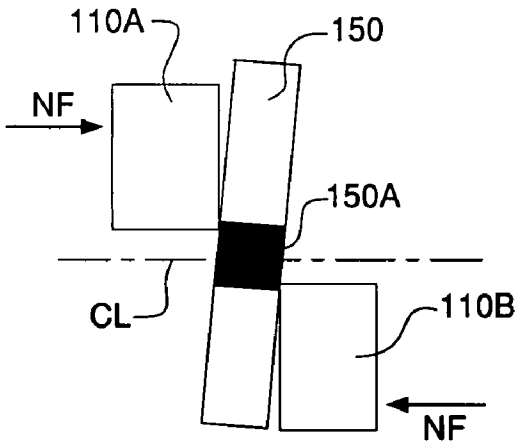
FIG. 1E PRIOR ART
FIG. 1E is a top view of a receptacle contact with a blade contact being inserted into the receptacle contact.
Figure 1D:
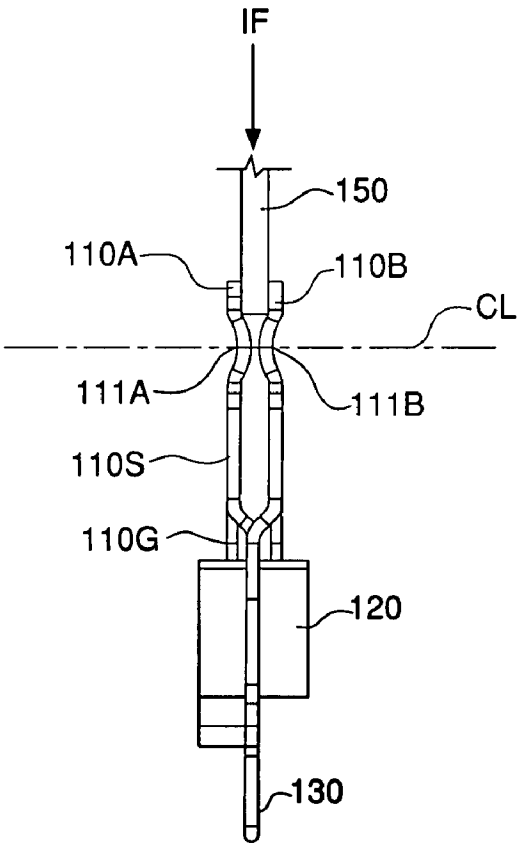
FIG. 1D PRIOR ART
FIG. 1D is an end view of the lead frame assembly of FIG. 1A with a blade contact being inserted into a receptacle contact.

As described with regard to FIG. 3A, the contact block 220 may include wells 225 that may receive ground blade contacts of a plug connector that are longer than signal blade contacts of the plug connector. Wells 125 are shown in FIG. 1A. In the contact block 120 of FIG. 1A, however, the wells 125 are formed such that both beams 110A and 110B of a ground receptacle contact 110G are inserted through a well 125 and into the contact block 120. Such a well 125 may be suitable for receiving both beams 110A, 110B of a receptacle contact 210. The wells 225 of the contact block 220, however, may receive one contact beam of the receptacle contact 210. As shown in FIG. 3A, for example, the wells 225 receive the contact beam 210B of the ground receptacle contacts 210G. The contact beam 210A may be inserted into or otherwise formed as part of the contact block 220 similar to the beams 210A, 210B of the signal receptacle contacts 210S.

The contact block 220 may additionally include protrusions 227 into which a beam 210A of each receptacle contact 220S, 220G may be inserted. The protrusions 227 may provide support to the receptacle contacts 210S, 210G so that the normal force NF(1) exerted by the contact beam 210A may be the same or similar to the normal force NF(2) exerted by the contact beam 210B.

The normal forces NF(1), NF(2) could be different, for example, if the receptacle contacts 210 were inserted into or formed as part of the contact block 120 of FIG. 1 instead of the contact block 220. If the receptacle contacts 210 were received in the contact block 120, then the formed area 211A of the contact beam 210 would be further from the contact block 220 than the formed area 211B. This may result in a normal force NF(1) exerted by the contact beam 210A on a blade contact being less than a normal force NF(2) exerted by the contact beam 210B.

The contact block protrusions 227, thus, may help equalize the normal forces NF(1), NF(2) exerted by each beam 210A, 210B of the receptacle contact 210. In the same way, one beam 210B of each receptacle ground contact 210G may be located corresponding to a well 225, while the other beam 210A of the receptacle ground contact 210G may be located corresponding to a protrusion 227 of the contact block 225. This may help equalize the normal forces NF(1), NF(2) exerted by the respective contact beams 210A, 210B of a receptacle ground contact 210G.

Figure 6:
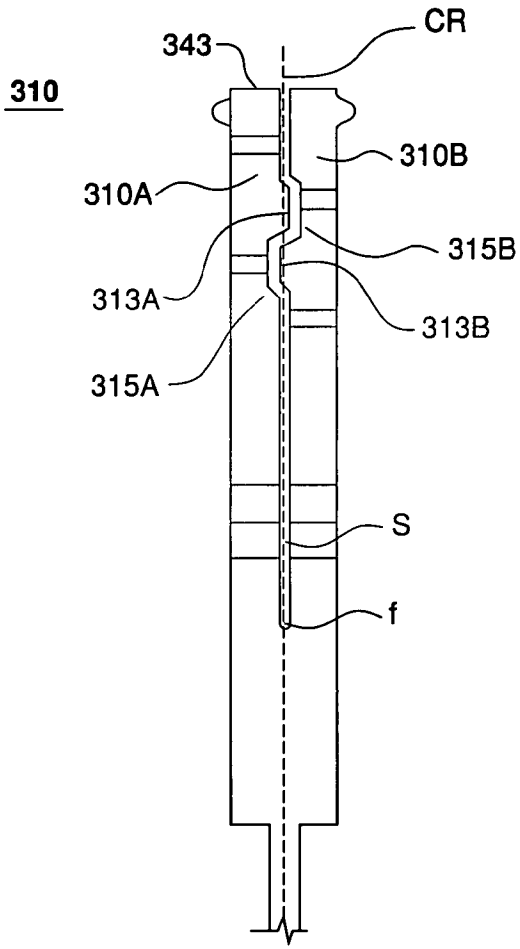
FIG. 6 is a side view of a further alternative receptacle contact.

FIG. 6 is a side view of an alternative receptacle contact 310. The receptacle contact 310 may be used in an electrical connector, for example, and may receive a plug contact such as a blade contact. Additionally, the receptacle contact 310 may include a terminal portion for connection with an electrical device such as, for example, a printed circuit board.

The receptacle contact 310 may include two beams 310A, 310B that separate from each other at a location f. A space S may be formed between the beams 310A, 310B. The space S may extend from the location f to the insertion end 343 of the receptacle contact 310. The dual beams 310A, 310B may be shaped into complementary forms such that a protrusion 313A, 313B on one beam 310A, 310B extends toward an indentation 315A, 315B defined by the other beam 310A, 310B. For example, the beam 3101 may include a protrusion 313B that extends toward the beam 310A. The protrusion 313B may extend from the beam 310B beyond a center reference line CR of the contact 310. At the location of the protrusion 313B, the contact beam 310A may define a corresponding indentation 315A. Likewise, the contact beam 310A may include a protrusion 313A. The protrusion 313 may extend from the beam 310A toward the beam 310B past the center reference line CR. The beam 310B may define an indentation 315B that corresponds to the protrusion 313A. Such a receptacle contact 310 may include any number of corresponding protrusions 313 and indentations 315.

The dual beam receptacle contact 310 may be stamped or otherwise produced from a single sheet of conductive material in a shape such as described herein and depicted in FIG. 6. Further, as explained in more detail herein, receptacle contacts 310 may enable "overlapping" of portions of the contact beams 310A, 310B such that each places an opposing normal force on a blade contact, reducing or eliminating rotation of the blade contact when inserted into the receptacle contact 310. The overlapping portions of the contact beams 310A, 310B may also result in increased mating surface area with a blade contact and thus may affect signal integrity.

The foregoing illustrative embodiments have been provided merely for the purpose of explanation and are in no way to be construed as limiting of the invention. Words which have been used herein are words of description and illustration, rather than words of limitation. Additionally, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. An electrical connector, comprising:

a contact block; and a receptacle contact received in the contact block, said receptacle contact comprising first and second contact beams that each extend along a first direction, the receptacle contact defining a center reference line between the first and second contact beams in the first direction, wherein (i) the first contact beam is opposed to the second contact beam in a second direction and is offset from the second contact beam in a third direction perpendicular to the first and second directions, (ii) the first contact beam defines a first indentation and the second contact beam defines a second protrusion at least partially extending toward the first indentation in the third direction and beyond the center reference line such that the protrusion is at least partially received in the first indentation, the second protrusion for contacting a contact element received between the first and second contact beams of the receptacle contact, and (iii) the second contact beam defines a second indentation and the first contact beam defines a first protrusion at least partially extending toward the second indentation, the first protrusion for contacting the contact element.

2. The electrical connector of claim 1, wherein the receptacle contact extends in the first direction from the contact block, and wherein the contact block defines a shape such that the first protrusion is located a first distance in the first direction from the contact block and the second protrusion is located a second distance in the first direction from the contact block.

3. The electrical connector of claim 1, wherein the first contact beam defines a first formed area extending toward the second contact beam, the first formed area for contacting the contact element.

4. The electrical connector of claim 3, wherein the first protrusion is at least partially within the first formed area.

5. The electrical connector of claim 1, wherein the receptacle contact is formed from a single sheet of conductive material.

6. The electrical connector of claim 1, further comprising a second receptacle contact, wherein the contact block provides a first normal force to the receptacle contact and a second normal force to the second receptacle contact.

7. The electrical connector of claim 6, wherein the first normal force is approximately equal to the second normal force.

8. An electrical connector, comprising:

a contact block; and a receptacle contact received in the contact block, defining a first contact beam and a second contact beam that each extend along a first direction, wherein (i) the first contact beam is opposed to the second contact beam in a second direction and is offset from the second contact beam in a third direction perpendicular to the first and second directions, (ii) the first contact beam defines a first formed area extending toward the second contact beam in the second direction, and further defines a first indention, and the second contact beam defines a second formed area extending toward the first contact beam and further defines a second protrusion extending toward the first indention in the third direction, (iii) the second contact beam further defines a second indentation and the first contact beam further defines a first protrusion extending at least partially toward the second indentation, and (iv) the first formed area is located to receive a blade contact inserted between the first and second contact beams such that the blade contact abuts the first formed area before abutting the second formed area.

9. The electrical connector of claim 8, wherein the first protrusion is at least partially located within the first formed area of the first contact beam.

10. The electrical connector of claim 8, wherein the receptacle contact is formed from a single sheet of conductive material.

11. The electrical connector of claim 8, wherein the first formed area is located to receive a rectangular blade contact.

12. The electrical connector of claim 8, wherein the receptacle contact extends in the first direction from the contact block, and wherein the contact block defines a shape such that the first formed area is located a first distance in the first direction from the contact block and the second formed area is located the first distance in the first direction from the contact block.

13. The electrical connector of claim 8, wherein the contact block defines a well and wherein the second contact beam is received in the well.

14. An electrical connector, comprising:

a contact block; and a receptacle contact received in the contact block, said receptacle contact comprising first and second contact beams that extend along a first direction, wherein (i) the first contact beam is opposed to the second contact beam in a second direction and is offset from the second contact beam in a third direction perpendicular to the first and second directions, (ii) a portion of the first contact beam overlaps with a portion of the second contact beam in the third direction, (iii) the first contact beam includes a first formed area that is curved and protrudes toward the second contact beam, and the second contact beam includes a second formed area that is curved and protrudes toward the first contact beam, (iv) both the first formed area and the second formed area intersect a common line about the second direction, (v) the first and second formed areas are formed such that, as a contact element is inserted between the first and second contact beams, the contact element at least partially overcomes a normal force exerted by the first contact beam before the second contact beam exerts a normal force on the contact element, and (vi) the normal force exerted by the first contact beam is in the second direction.

15. The electrical connector of claim 14, wherein the first contact beam defines a first indentation and the second contact beam defines a second protrusion at least partially extending toward the first indentation, the second protrusion for contacting the contact element received in the receptacle contact.

* * * * *